US011944148B2

(12) United States Patent
Becker et al.

(10) Patent No.: US 11,944,148 B2
(45) Date of Patent: Apr. 2, 2024

(54) PROTECTIVE HELMET

(71) Applicant: Schuberth GmbH, Magdeburg (DE)

(72) Inventors: Jan-Christian Becker, Braunschwei (DE); Thomas Schulz, Koenigslutter (DE); Markus Moebius, Welsleben (DE); Thomas Hagemeier, Magdeburg (DE); Christian Dittmer-Peters, Koenigslutter (DE); Sven Bartels, Genthin (DE); Sebastian Reitebuch, Berlin (DE)

(73) Assignee: SCHUBERTH GMBH, Magdeburg (DE)

( * ) Notice: Subject to any disclaimer, the term of this patent is extended or adjusted under 35 U.S.C. 154(b) by 0 days.

(21) Appl. No.: 16/971,273

(22) PCT Filed: Feb. 19, 2019

(86) PCT No.: PCT/EP2019/054026
§ 371 (c)(1),
(2) Date: Aug. 19, 2020

(87) PCT Pub. No.: WO2019/158766
PCT Pub. Date: Aug. 22, 2019

(65) Prior Publication Data

US 2020/0375294 A1 Dec. 3, 2020

(30) Foreign Application Priority Data

Feb. 19, 2018 (DE) ..... 10 2018 103 657.4

(51) Int. Cl.
*A42B 3/04* (2006.01)
*A42B 3/20* (2006.01)
(Continued)

(52) U.S. Cl.
CPC ..... *A42B 3/04* (2013.01); *A42B 3/205* (2013.01); *A42B 3/326* (2013.01); *A42B 3/227* (2013.01)

(58) Field of Classification Search
CPC .. A42B 3/04; A42B 3/30; A42B 3/326; A42B 3/227
See application file for complete search history.

(56) References Cited

U.S. PATENT DOCUMENTS 3,422,224 A 1/1969 Curran
3,470,558 A 9/1969 Raschke
(Continued)

FOREIGN PATENT DOCUMENTS

CN 2540799 Y 3/2003
CN 1627651 A 6/2005
(Continued)

OTHER PUBLICATIONS

Rajpurohit, A. "Fiber Reinforced Composites: Advances in Manufacturing Techniques.", Researchgate; https://www.researchgate.net/publication/279885386. (Year: 2014).
(Continued)

*Primary Examiner* — Khoa D Huynh
*Assistant Examiner* — Erick I Lopez
(74) *Attorney, Agent, or Firm* — McCarter & English, LLP

(57) ABSTRACT

The invention relates to a protective helmet with an outer shell (1) for distributing impact forces, an interior layer (2) accommodated by the outer shell (1) for attenuating impact forces, and a slot (3) for accommodating an electrical device (4), wherein the outer shell (1) has a chin shell area (6) to cover a chin portion of a protective helmet wearer, wherein the outer shell (1) forms a viewing port (8) for the protective helmet wearer to look through. The protective helmet is
(Continued)

characterized in that the slot (3) is arranged on the chin shell area (6) in such a way that the accommodated electrical device (4) is arranged between the chin shell area (6) and the interior layer (2), wherein the protective helmet has an interior cover (10) for essentially completely covering the accommodated electrical device (4) in the direction of the viewing port (8).

19 Claims, 2 Drawing Sheets

(51) Int. Cl.
*A42B 3/22* (2006.01)
*A42B 3/32* (2006.01)

(56) References Cited

U.S. PATENT DOCUMENTS 3,582,951 A 6/1971 Altmayer
3,885,246 A 5/1975 Tung
3,963,917 A 6/1976 Romano
3,977,003 A 8/1976 Kershaw
4,077,007 A 2/1978 McKinney
4,109,105 A 8/1978 Von Statten, Jr.
4,130,803 A 12/1978 Thompson
4,152,553 A 5/1979 White
4,178,411 A 12/1979 Cole et al.
4,239,106 A 12/1980 Aileo
4,321,433 A 3/1982 King
4,357,711 A 11/1982 Drefko et al.
4,400,591 A 8/1983 Jennings et al.
4,466,138 A 8/1984 Gessalin
4,519,099 A 5/1985 Kamiya et al.
4,563,392 A 1/1986 Harpell et al.
4,719,462 A 1/1988 Hawkins
4,729,132 A 3/1988 Fierro
4,833,726 A 5/1989 Shinoda et al.
4,903,350 A 2/1990 Gentes et al.
4,950,439 A 8/1990 Smith et al.
5,119,505 A 6/1992 Tisseront et al.
5,136,657 A * 8/1992 Hattori ..... A42B 3/127 379/430
5,142,700 A 8/1992 Reed
5,183,701 A 2/1993 Jacobs et al.
5,291,203 A 3/1994 Schneck
5,327,588 A 7/1994 Garneau
5,329,637 A 7/1994 Walker
5,357,409 A 10/1994 Glatt
5,438,702 A 8/1995 Jackson
5,448,780 A 9/1995 Gath
5,508,900 A 4/1996 Norman
5,615,410 A 3/1997 DeMars
5,683,831 A 11/1997 Baril et al.
5,718,004 A 2/1998 Broersma et al.
5,743,621 A 4/1998 Mantha et al.
5,749,096 A 5/1998 Fergason et al.
5,862,528 A 1/1999 Saijo et al.
5,886,667 A 3/1999 Bondyopadhayay
5,931,559 A 8/1999 Pfaeffle
5,996,128 A 12/1999 Yanagihara
6,009,563 A 1/2000 Swanson et al.
6,081,929 A 7/2000 Rothrock et al.
6,336,220 B1 1/2002 Sacks et al.
6,464,369 B1 10/2002 Vega et al.
6,691,325 B1 2/2004 Pelletier et al.
6,701,537 B1 3/2004 Stamp
7,377,666 B1 5/2008 Tyler
7,532,163 B2 5/2009 Chang et al.
7,555,312 B2 6/2009 Kim et al.
7,555,788 B2 7/2009 Schimpf
7,901,104 B2 3/2011 McLean et al.
8,001,623 B2 8/2011 Gertsch et al.
8,009,229 B1 8/2011 Peterson
8,245,326 B1 8/2012 Tolve
8,544,399 B2 10/2013 Miloslavsky
8,545,959 B2 10/2013 McGuire, Jr. et al.
8,667,617 B2 3/2014 Glezerman et al.
8,853,105 B2 10/2014 Bhatnagar et al.
8,908,389 B2 12/2014 Teetzel et al.
9,070,978 B2 6/2015 Boni et al.
9,247,779 B1 2/2016 Aloumanis et al.
9,445,639 B1 9/2016 Aloumanis et al.
9,456,649 B2 10/2016 Basson
9,486,027 B2 11/2016 Dey et al.
9,585,433 B1 3/2017 Heimer et al.
9,686,136 B1 6/2017 Dey et al.
9,711,146 B1 7/2017 Cronin
9,833,933 B2 12/2017 Cadens Ballarin
9,968,153 B2 5/2018 Thompson et al.
10,051,908 B2 8/2018 Redpath et al.
10,160,156 B2 12/2018 Pourboghrat et al.
10,219,571 B1 3/2019 Aloumanis et al.
10,383,384 B2 8/2019 Zhavoronkov et al.
10,779,604 B2 9/2020 Lebel et al.
10,806,204 B2 10/2020 Pritz
10,814,524 B2 10/2020 Prins et al.
10,856,599 B1 12/2020 Cuenca
11,278,076 B2 3/2022 Suddaby
11,633,303 B2 4/2023 Persson et al.
11,660,846 B2 5/2023 Drzal et al.
2005/0017911 A1 1/2005 Lee
2006/0232955 A1 10/2006 Labine
2006/0277664 A1 12/2006 Akhtar et al.
2007/0220662 A1 9/2007 Pierce
2007/0289044 A1 12/2007 Ellis
2008/0068825 A1 3/2008 Harris
2008/0130271 A1 6/2008 Harris
2009/0064386 A1 3/2009 Rogers
2009/0158508 A1 6/2009 Quaranta et al.
2009/0199317 A1 8/2009 Schwiers et al.
2010/0175172 A1 7/2010 Dempsey et al.
2010/0287687 A1 11/2010 Ho
2011/0302701 A1 12/2011 Kuo
2012/0011631 A1 1/2012 Crossman et al.
2012/0077438 A1 3/2012 Jung
2012/0189153 A1 7/2012 Kushnirov et al.
2012/0272435 A1 11/2012 Glezerman et al.
2013/0007949 A1 1/2013 Kurs et al.
2013/0081199 A1 * 4/2013 Nimura ..... A42B 3/326 2/421
2013/0176183 A1 7/2013 Boni et al.
2013/0190052 A1 7/2013 Lundell
2013/0305437 A1 11/2013 Weller et al.
2014/0000013 A1 1/2014 Redpath et al.
2014/0000014 A1 1/2014 Redpath et al.
2014/0020159 A1 1/2014 Teetzel et al.
2014/0109297 A1 4/2014 Lanez
2014/0189938 A1 7/2014 Redpath et al.
2014/0362244 A1 12/2014 Martin
2015/0038199 A1 2/2015 Shirashi
2015/0223547 A1 8/2015 Wibby
2015/0282549 A1 10/2015 Lebel et al.
2016/0100649 A1 4/2016 Glezerman et al.
2016/0106174 A1 4/2016 Chung et al.
2016/0249700 A1 9/2016 Zhavoronkov et al.
2017/0006955 A1 1/2017 Dow, II et al.
2017/0052000 A1 2/2017 White et al.
2017/0367433 A1 12/2017 Frett
2018/0221915 A1 8/2018 Simor et al.
2018/0275928 A1 9/2018 Boksteyn
2018/0289095 A1 10/2018 Catterson et al.
2019/0104797 A1 4/2019 Teetzel et al.
2019/0191808 A1 6/2019 Becker et al.
2019/0269193 A1 9/2019 Benyola
2019/0320753 A1 10/2019 Le et al.
2019/0380417 A1 12/2019 Zhavoronkov et al.
2019/0387829 A1 12/2019 Becker et al.
2020/0015537 A1 1/2020 Becker et al.

(56) References Cited

U.S. PATENT DOCUMENTS

| | | | |
|---|---|---|---|
| 2020/0037693 | A1 | 2/2020 | Klimek et al. |
| 2020/0305532 | A1 | 10/2020 | Lange et al. |

FOREIGN PATENT DOCUMENTS

| | | | | |
|---|---|---|---|---|
| CN | 1715734 | A | 1/2006 | |
| CN | 201319192 | Y | 9/2009 | |
| CN | 102791157 | A | 11/2012 | |
| CN | 202919121 | U | 5/2013 | |
| CN | 104871384 | A | 8/2015 | |
| CN | 204949670 | U | 1/2016 | |
| CN | 205106513 | U | 3/2016 | |
| CN | 206043574 | U | 3/2017 | |
| CN | 106659261 | A | 5/2017 | |
| CN | 206312966 | U | 7/2017 | |
| CN | 206560075 | U | 10/2017 | |
| DE | 3042159 | A1 | 6/1982 | |
| DE | 8226935 | U1 * | 9/1982 | ..... A42B 3/0406 |
| DE | 8226935 | U1 | 2/1983 | |
| DE | 29519601 | U1 | 2/1996 | |
| DE | 29906107 | U1 | 7/1999 | |
| DE | 29914563 | U1 | 1/2000 | |
| DE | 102005038893 | A1 | 3/2006 | |
| DE | 202011051831 | U1 | 11/2011 | |
| DE | 102015216835 | A1 | 3/2017 | |
| DE | 102016115889 | A1 | 3/2018 | |
| EP | 0412205 | A1 | 2/1991 | |
| EP | 1393643 | A1 | 3/2004 | |
| EP | 2183989 | A1 | 5/2010 | |
| FR | 2335169 | A1 | 7/1977 | |
| FR | 2668901 | A1 | 5/1992 | |
| GB | 826012 | A | 12/1959 | |
| GB | 974901 | A | 11/1964 | |
| GB | 2059206 | A | 4/1981 | |
| GB | 2254528 | A | 10/1992 | |
| JP | S6468507 | A | 3/1989 | |
| JP | 2000328342 | A | 11/2000 | |
| JP | 2005060889 | A | 3/2005 | |
| JP | 2011-002958 | A | 1/2011 | |
| KR | 20010011095 | A | 2/2001 | |
| KR | 101530061 | B1 | 6/2015 | |
| WO | 2004032658 | A1 | 4/2004 | |
| WO | 2011129576 | A2 | 10/2011 | |
| WO | 2012006653 | A1 | 1/2012 | |
| WO | 2012017836 | A1 | 2/2012 | |
| WO | 2012148519 | A1 | 11/2012 | |
| WO | 2016001915 | A1 | 1/2016 | |
| WO | 2016022984 | A1 | 2/2016 | |
| WO | 2018/043025 | A1 | 3/2018 | |

OTHER PUBLICATIONS

Wikipedia, Wireless Personal Area Network, https://de.wikipedia.org/w/index.php?title=Wireless_Personal_Area_Network, printed Mar. 27, 2018, 4 pages.

International Search Report for Application No. PCT/EP2019/054026, dated May 2, 2019, 5 pages.

Written Opinion for Application No. PCT/EP2019/054026, dated May 2, 2019, 14 pages.

D'Hooghe et al., Thermoplastic Composite Technology; Tougher Than You Think. Adv Mat. 2000;12(23):1865-1868.

* cited by examiner

PROTECTIVE HELMET

CROSS-REFERENCE TO RELATED APPLICATIONS

This application is a national stage application of international application no. PCT/EP2019/054026 filed Feb. 19, 2019, entitled "Protective Helmet," claiming priority to German application no. DE 10 2018 103 657.4 filed Feb. 19, 2018, which are hereby expressly incorporated by reference as part of the present disclosure.

FIELD OF THE INVENTION

The present disclosure relates to a protective helmet.

BACKGROUND

Modern protective helmets increasingly have not only mechanical devices and features, such as a visor, a ventilator and turbulators, etc., but also electrical devices, which can also be referred to as electric-powered devices, which are either fixedly arranged on the protective helmet or can be detachably fastened thereto.

There are various ways of changeably fastening such an electrical device to a protective helmet. One way involves fastening such an electrical device to the protective helmet using a strap rigidly connected with the electrical device, specifically by introducing the strap between the outer shell, e.g., made out of expanded polystyrene, and the inner layer, e.g., a pad, at the lower edge of the protective helmet. The advantage to this approach is that no special fastening option need be provided on the protective helmet itself, so that virtually any protective helmet can be used for fastening purposes. The disadvantage on the one hand is that this type of fastening only offers little protection to the electrical device against inadvertently detaching from the protective helmet. Likewise disadvantageous is that this type of fastening is also not possible on any circumferential position of the protective helmet, since for example the areas below the visor would be unsuitable.

Another way involves providing a preconfigured slot on an outer surface of the outer shell of the protective helmet, wherein the electrical device can then be plugged into this slot. In this way, a reliable fastening of the electrical device can be achieved by providing respective devices for fastening to the slot and to the electrical device. However, the disadvantage is that the exterior shape of the outer shell has to be adjusted to provide such a slot, for example so as to deviate from the in itself mechanically advantageous spherical or oval shape. The material thickness of the outer shell also most often does not remain uniform in this variant.

Known from prior art is international published patent application WO 2004/032658 A1, which describes a racing helmet. This racing helmet has a helmet shell, the inside of which is lined with a shock-absorbing material, and which in turn has a recess comprising a viewing field for the helmet wearer, as well as a chinstrap running below the viewing field. The inside of the chinstrap is provided with a pot-shaped structure, which is provided for accommodating an indicator device. As a result of this arrangement, the indicator device is located in the viewing field of the helmet wearer. On the other hand, the indicator device can basically fall out of the recess or otherwise come into contact with the face of the helmet wearer. Furthermore, it is virtually impossible to manually operate the indicator device without taking off the racing helmet. As a whole, this arrangement is not suitable for a device that is not an indicator device.

Also known from prior art is American published patent application US 2013/0176183 A1, which describes an essentially linear dipole antenna for protective helmets having two conductive branches that are connected at one respective end with a wireless device and essentially identically aligned. The wireless device is centrally introduced at a rear end underneath the outer shell in such a way that the two branches of the dipole antenna are arranged essentially symmetrical to the vertical central plane of the protective helmet running in the viewing direction. A suitable alignment with respect to emission behavior is to be achieved in this way. The disadvantage to this prior art is the fact that the positioning at the back of the head hampers the operation or other manipulation of the device positioned there.

SUMMARY

Against this backdrop, the object is to develop and improve a protective helmet in such a way that an electrical device can be safely placed on the protective helmet, while minimizing any impairment to the function of the outer shell and maximizing the ability to manually access the electrical device.

According to at least some embodiments, a slot for an electrical device can also be provided in a chin area of the protective helmet, thereby ensuring a good manual accessibility even without taking off the protective helmet. As opposed to an arrangement on the back of the head or generally in a rear area of the protective helmet, no change in gravity of the helmet wearer is required during such a manual access, since the corresponding arm only has to be moved over a short distance. In order to protect against injuries and visual impairment, it is here ensured that a cover covers the received electrical device relative to the visual field.

The protective helmet according to at least some embodiments, which can involve a protective motorcycle helmet, has an outer shell for distributing impact forces, an interior layer accommodated by the outer shell for attenuating impact forces, and a slot for accommodating an electrical device, wherein the outer shell has a chin shell area to cover a chin portion of a protective helmet wearer. This chin shell area can completely or partially cover the chin area of the protective helmet wearer. In the protective helmet according to at least some embodiments, the outer shell forms a viewing port arranged above the chin shell area for the protective helmet wearer to look through. It may be that the protective helmet has a visor for the viewing port that consists for example of polycarbonate.

The protective helmet according to at least some embodiments is characterized in that the slot is arranged on the chin shell area in such a way that the accommodated electrical device is arranged between the chin shell area and the interior layer, wherein the protective helmet has an interior cover for essentially completely covering the accommodated electrical device in the direction of the viewing port. In other words, this interior cover blocks the electrical device from shifting in the direction of the viewing port proceeding from the slot.

The interior cover can basically be configured in such a way as to allow a movement by the electrical device in another direction—or in several. At least one embodiment of the protective helmet is characterized in that the outer shell defines an interior space for accommodating the head of a protective helmet wearer, and that the interior cover essentially completely covers the accommodated electrical device relative to the interior space. In such a case, the electrical device can only be removed from the slot in one direction that leads away from the interior space.

The interior cover can basically involve any device made out of basically any material. However, in at least some embodiments, the interior layer comprises the interior cover. As a consequence, the interior cover also consists of the same material as the interior layer for attenuating impact forces.

In at least some embodiments, the outer shell consists of multiple pieces, and has a cranial area separate from the chin shell area to cover the cranium of a protective helmet wearer, and that the protective helmet has a coupling mechanism to couple the chin shell area with the cranial area. In this way, the chin shell area can be regionally separated from the cranial area, for example to make it easier to put on or take off the helmet. The chin shell area may have two essentially opposing flank areas and a front area arranged between the flank areas. The front area here corresponds to the area of the middle of the chin of a protective helmet wearer, wherein this front area is laterally flanked by the flank areas.

The above coupling mechanism can basically be configured as desired. In at least some embodiments, the coupling mechanism may be set up to swivel the chin shell area relative to the cranial area. This swiveling allows a comfortable separation of the chin shell area from the cranial area. In at least some embodiments, swiveling may take place around a swivel axis that is transverse to a viewing direction of the protective helmet wearer. With the electrical device accommodated in the slot, the electrical device can likewise be swiveled with the chin shell area. This can also facilitate access to the electrical device or the slot.

The guide for the electrical device in the slot can basically be as desired. In this regard, in at least some embodiments of the protective helmet the slot is set up to guide the electrical device being accommodated essentially along an interior side of the chin shell area, so that the accommodated electrical device essentially extends along the interior side of the chin shell area. This results in an ergonomically suitable direction of insertion for the electrical device.

Apart from the outer shell, the protective helmet can also have additional layers. In at least some embodiments, the protective helmet has an interior layer for attenuating impact forces, and that the accommodated electrical device is arranged between the outer shell and the interior layer. This also minimizes the risk of injuries caused by the electrical device.

In at least some embodiments, the chin shell area can be swiveled relative to the cranial area so as to be alternately moved into a first swivel position and into a second swivel position. In at least some embodiments, a contact surface is arranged on the chin shell area, which in the first swivel position is covered by a counter-surface arranged in the cranial area, and in the second swivel position is arranged spaced apart from the counter-surface. Let it be noted that the contact surface and counter surface here need not be part of the outer shell—and hence also not of the chin shell area or cranial area, but rather can also consist of a different material, and arranged on the outer shell, i.e., the chin shell area or cranial area.

In at least some embodiments, the slot has a frame consisting essentially of plastic and arranged on the interior relative to the outer shell for formfittingly accommodating the electrical device, with a frame opening for inserting the electrical device. This permits a safe and precise accommodation of the electrical device, and thus also a reliable electrical contacting. In at least some embodiments, the frame be swiveled with the chin shell area while swiveling the chin shell area. It can here be the case that the electrical device be only partially accommodated by the frame, and thus that a portion of the electrical device protrude from the frame.

It can be the case that the electrical device has activatable operating elements, and for example pushbuttons for operating the electrical device. These can be arranged in such a way that the operating elements protrude from the frame as the frame accommodates the electrical device. The operating elements are set up to be activated by pressing in a direction of insertion of the frame. This ensures that the electrical device accommodated by the slot can be ergonomically operated as well.

In at least some embodiments, the frame borders a lower edge of the chin shell area. Here and in the following, the directional indication "below" relates to a person wearing the protective helmet. The frame opening may be arranged essentially on the lower edge of the outer shell. Alternatively or additionally, the frame opening can essentially be arranged on the contact surface.

In at least some embodiments, the frame extends essentially along the chin shell area proceeding from the frame opening. It may be the case that the electrical device is inserted into the frame in essentially a vertically upper direction. The vertical direction here relates to the position of a protective helmet worn by a protective helmet wearer. As an alternative, the electrical device is inserted into the frame in essentially a horizontal direction. This horizontal direction may also relates to the position of a protective helmet worn by a protective helmet wearer. In at least some embodiments, the vertical direction and/or the horizontal direction relate to the first swivel position.

The electrical device can basically be held in the slot in any manner desired. In at least some embodiments, the slot has a snap device for establishing a formfitting engagement to hold the electrical device, for example, in the frame. This makes it easy to both manufacture the electrical device and securely fasten it in the slot. The snap device may be arranged spaced apart from the frame opening. It may be the case that this spaced apart arrangement is present in such a way that the snap device is covered by an electrical device accommodated by the frame. This prevents the electrical device from inadvertently detaching from the snap device.

In at least some embodiments the slot, for example, the frame, has a wall against which the accommodated electrical device flatly abuts, and that the snap device has at least one hook, wherein this at least one hook adjustably protrudes from the wall for establishing a formfitting engagement to hold the electrical device.

This adjustability may be achieved by an elastic deformability of the snap device or an arm of the snap device. In this variant, the hook may be first moved in the direction of the wall while inserting the electrical device into the slot, and in at least some embodiments during insertion into the frame. Starting at a specific point during the insertion of the electrical device, the hook can snap back and establish the formfitting engagement. In such a case, various approaches are basically conceivable for again releasing this formfitting engagement. For example, it can be provided that the at least one hook be arranged in such a way that it can be pressed into the wall by inserting a releasing device between the wall and the accommodated electrical device, so that the formfitting engagement for holding the electrical device is released. Such a releasing device can have a flat and/or card-like configuration. The snap device can be set up to release the formfitting engagement for holding the electrical device by using the releasing device.

At least some embodiments of the protective helmet provide that the protective helmet has an electrical device, for example, an electrically operable modular device, which may be fixedly fastened to the outer shell and electrically connected with the slot, and that the protective helmet has a pole arrangement for detachably electrically connecting—for example, the modular device—with the accommodated electrical device. The modular device can also be detachably fastened to the outer shell. The electrical connection can be contactless on the one hand, e.g., use magnetic induction. This electrical connection can likewise have a mechanical contacting means, for example, comprising a formfitting connection between the electrical device and the pole arrangement. Accordingly, the pole arrangement can involve a pole contact arrangement for detachable electrical contacting. In this way, an electrical device accommodated by the slot is electrically connected in a reliable manner with the modular device. In at least some embodiments, the pole arrangement has a plurality of individual contacts for respectively contacting the electrical device. In at least some embodiments, the pole contact arrangement has a plurality of individual contacts for respectively contacting the electrical device. The pole arrangement can be fastened to the chin shell area and may be enveloped by the slot. It can likewise be that the pole arrangement is fastened to the cranial area. It may be the case that an electrical device accommodated by the slot is electrically connected with the pole arrangement via the coupling mechanism by swiveling the chin shell area relative to the cranial area.

Both the electrical device and the modular device can each basically involve any kind of electrical device. The modular device can also comprise a voltage source and in at least some embodiments, a battery, or consist of such a voltage source or battery. In at least some embodiments, the modular device can comprise a voltage source or battery for supplying electricity to the electrical device. Conversely, the electrical device can also comprise or consist of a battery or voltage source, for example, for supplying the modular device. It can further be that the electrical device and/or the modular device have or consist of a digital communication device, for example, a Bluetooth communication device. Finally, the electrical device and/or the modular device can have an operating device for such a digital communication device.

It can be the case that the modular device and the electrical device are two components of a common overall device, which only becomes functional as the result of this connection. The electrical device is then a replaceable component of this overall device.

It can be the case that the modular device is fastened to the cranial area of the outer shell. It can then be the case that the protective helmet has a line arrangement for electrically connecting the modular device with the electrical device. If the pole arrangement is also arranged on the cranial area of the outer shell, it then becomes unnecessary to establish the electrical connection from the chin shell area to the cranial area. However, it can also be the case that the line arrangement comprises an electrical connection from the chin shell area to the cranial area. On the one hand, the line arrangement can be guided by the coupling mechanism. On the other hand, the line arrangement can also comprise a line contact arrangement with a first electrical contact on the chin shell area and a second electrical contact on the cranial area, wherein the first electrical contact can be electrically connected with and detached from the second electrical contact via the coupling mechanism by swiveling the chin shell area relative to the cranial area.

In at least some embodiments, the pole arrangement has at least one plug contact for formfitting connection with the electrical device. Alternatively or additionally, it can be the case that the pole arrangement has at least one sliding contact for formfitting-free connection with the electrical device.

In at least some embodiments of the protective helmet, the protective helmet has an electrical device accommodated by the slot.

This summary is not exhaustive of the scope of the present aspects and embodiments. Thus, while certain aspects and embodiments have been presented and/or outlined in this summary, it should be understood that the present aspects and embodiments are not limited to the aspects and embodiments in this summary. Indeed, other aspects and embodiments, which may be similar to and/or different from, the aspects and embodiments presented in this summary, will be apparent from the description, illustrations, and/or claims, which follow.

It should also be understood that any aspects and embodiments that are described in this summary and do not appear in the claims that follow are preserved for later presentation in this application or in one or more continuation patent applications.

BRIEF DESCRIPTION OF THE DRAWINGS

Additional configurations may be derived from the following description with reference to the figures. The drawings only illustrate an exemplary, non-limiting embodiment, in which.

DETAILED DESCRIPTION

Figure 1:
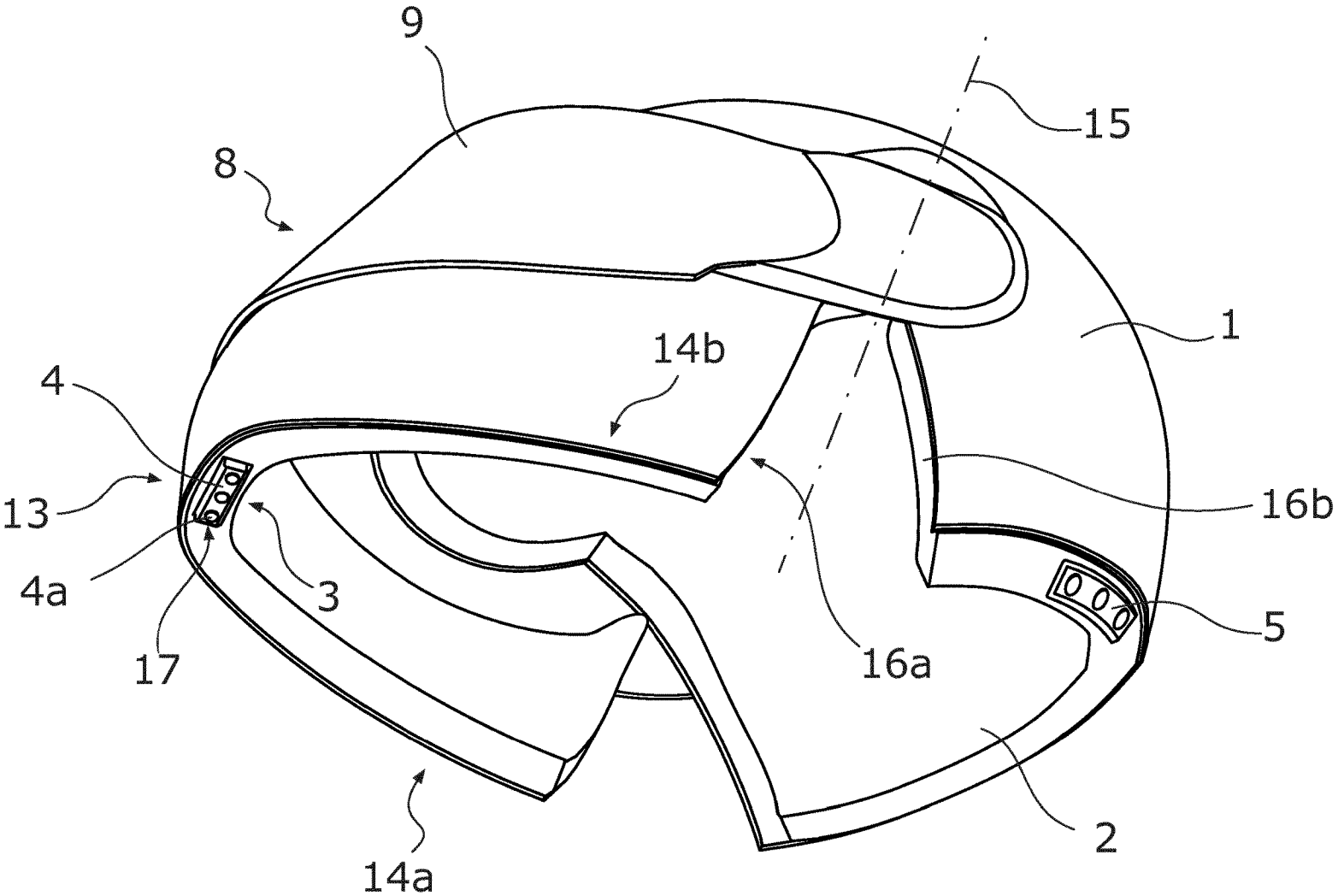
FIG. 1 shows a schematic, perspective view of a proposed protective helmet with an accommodated electrical device.

The proposed protective helmet shown on FIG. 1 is a protective motorcycle helmet. It has an outer shell 1 made of fiberglass with an added special resin and an interior layer 2 made of expanded polystyrene. The outer shell 1 defines an interior space 11 sketched out on FIG. 2 for accommodating the head of the protective helmet wearer. The protective helmet likewise has a slot in which an electrical device 4 is accommodated. This electrical device 4 involves an operating unit with activatable operating elements 4*a* for an electrical modular device 5, which here is designed as a Bluetooth module. As evident from FIGS. 1 and 2, the outer shell 1 has a multipiece design, and has a chin shell area 6 and a cranial area 7, wherein the chin shell area 6 is divided into a front area 13 laterally flanked by two side areas 14*a, b*. A viewing port 8 of the protective helmet with a visor 9 is arranged above the chin shell area 6. A coupling mechanism 12 shown on FIG. 1 makes it possible to swivel the chin shell area 6 relative to the cranial area 7 around a swivel axis 15, wherein the slot 3 and an electrical device 4 accommodated by the slot 3 are thus likewise swiveled. Both FIG. 1 and FIG. 2 here show a swivel position of the chin shell area 6 in which the one counter-surface 16*b* is visible on the cranial area 7, which is covered by a corresponding contact surface 16*a* on the chin shell area 6 while the chin shell area 6 swivels back. The contact surface 16 and counter-surface 16*b* are here not limited to the outer shell 1.

Figure 2:
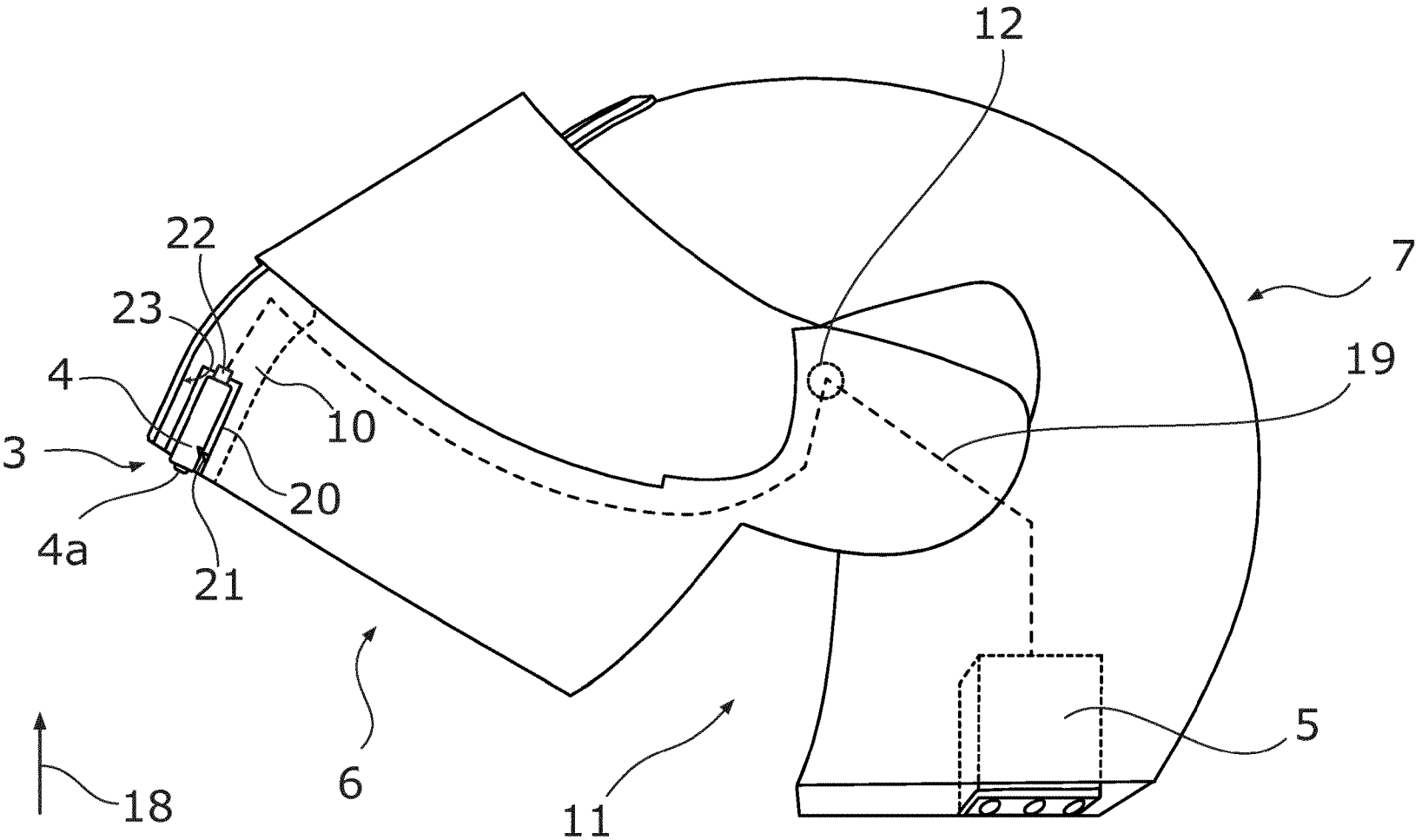
FIG. 2 shows a schematic diagram of the electrical connection for the protective helmet on FIG. 1.

As evident from at least FIG. 2, the slot 3 is configured and arranged on the chin shell area 6 in such a way that the accommodated electrical device 4 is guided along an interior side 23 of the chin shell area 6 in a vertically upper direction 18—relative to the swiveled back swivel position not shown here, and that the accommodated electrical device 4 is placed between the chin shell area 6—i.e., the corresponding part of the outer shell 11—and the interior layer 2. The protective helmet further has an interior cover 10 here formed by a corresponding part of the interior layer 2, which completely covers the electrical device 4 in the slot 3 in the direction of the viewing port 8—i.e., in the upper direction. The interior cover 10 likewise completely covers the accommodated electrical device 4 relative to the interior space 11. The frame 20 of the slot 3 for formfittingly accommodating the electrical device 4 is schematically depicted on FIG. 2. The corresponding frame opening 17 of the frame 20 for inserting the electrical device 4 is arranged at the lower edge of the chin shell area 6, and hence of the outer shell 1. In the frame 20, the slot 3 has a—here only depicted schematically as well—snap device 21 with a hook protruding from a wall of the frame 20 for establishing a formfitting engagement to hold the electrical device 4.

The modular device 5 is fixedly fastened to the outer shell 1, and connected by means of a line arrangement 19 that runs via the coupling mechanism 12 of the protective helmet with a pole arrangement 22 for purposes of electrical coupling with the electrical device. The pole arrangement 22 consists of both a plug contact and a sliding contact for connection with the electrical device 4.

While the above describes certain embodiments, those skilled in the art should understand that the foregoing description is not intended to limit the spirit or scope of the present disclosure. It should also be understood that the embodiments of the present disclosure described herein are merely exemplary and that a person skilled in the art may make any variations and modification without departing from the spirit and scope of the disclosure. All such variations and modifications, including those discussed above, are intended to be included within the scope of the disclosure.

The invention claimed is:

1. A protective helmet, comprising:

an outer shell adapted to distribute impact forces, wherein the outer shell includes a chin shell portion configured to cover at least a part of a chin portion of a wearer and a viewing port configured for a wearer to look through;

an interior layer within the outer shell adapted to attenuate impact forces;

a slot between the chin shell portion and the interior layer;

a frame located within the slot interiorly relative to the outer shell, the frame substantially comprising plastic and configured to formfittingly receive therein an electrical device; and wherein the frame defines a frame opening configured for inserting therein said electrical device;

wherein the frame borders a lower edge of the chin shell portion;

wherein the frame opening is located at the lower edge of the outer shell; and wherein the frame is made of a different material than both the outer shell and the interior layer.

2. The protective helmet according to claim 1, wherein the helmet defines an interior space configured to accommodate a head of a wearer, and interior cover is configured to separate an electrical device received within the frame from the interior space.

3. The protective helmet according to claim 1, the outer shell further comprising a cranial portion separate from the chin shell portion and configured to cover a cranium of a wearer, and a coupling configured to couple the chin shell portion with the cranial portion.

4. The protective helmet according to claim 3, wherein the coupling is configured to allow the chin shell portion to swivel relative to the cranial portion.

5. The protective helmet according to claim 4, wherein the coupling is configured to allow the chin shell portion to swivel relative to the cranial portion about a swivel axis that is at least transverse to a viewing direction of the wearer.

6. The protective helmet according to claim 5, configured so that when an electrical device is received within the frame said electrical device swivels with swiveling of the chin shell portion.

7. The protective helmet according to claim 3, wherein the chin shell portion is swivelable relative to the cranial portion between a first swivel position and a second swivel position.

8. The protective helmet according to claim 7, wherein the chin shell portion includes a contact surface and the cranial portion includes a counter surface, wherein in the first swivel position the counter surface covers the contact surface and in the second swivel position the contact surface is spaced from the counter surface.

9. The protective helmet according to claim 1, wherein the frame is configured to guide and receive an electrical device being inserted into the frame along an interior side of the chin shell portion.

10. The protective helmet according to claim 1, wherein the frame is configured to receive an electrical device received within the frame between the outer shell and the interior layer.

11. The protective helmet according to claim 1, wherein the frame extends along the chin shell portion from the frame opening.

12. The protective helmet according to claim 11, wherein the frame is configured for insertion of an electrical device into the frame in a vertically upwards direction or in a horizontal direction.

13. The protective helmet according to claim 1, wherein the frame has a snap device that defines a formfitting engagement configured to hold an electrical device received within the frame.

14. The protective helmet according to claim 13, wherein the slot is defined by at least one wall and is configured to flatly abut an electrical device received within the frame flatly against said at least one wall, and the snap device has at least one hook, wherein said at least one hook adjustably protrudes relative to the at least one wall and at least partially defines said formfitting engagement.

15. The protective helmet according to claim 1, wherein the protective helmet has an electric modular device and a pole arrangement configured to detachably electrically connect with an electrical device received within the frame.

16. The protective helmet according to claim 15, wherein the protective helmet has a line configured to electrically connect the modular device with an electrical device received within the frame.

17. The protective helmet according to claim 15, wherein the pole arrangement has at least one plug contact configured to formfittingly connect with an electrical device received within the frame.

18. The protective helmet according to claim 1, wherein the chin shell portion and the frame together are swivelable relative to the cranial portion.

19. A protective helmet, comprising:

an outer shell adapted to distribute impact forces, wherein the outer shell includes a chin shell portion configured to cover at least a part of a chin portion of a wearer and a viewing port configured for a wearer to look through;

an interior layer within the outer shell adapted to attenuate impact forces;

a slot between the chin shell portion and the interior layer;

a frame located within the slot interiorly relative to the outer shell, the frame substantially comprising plastic and configured to formfittingly receive therein an electrical device; and wherein the frame defines a frame opening configured for inserting therein said electrical device;

wherein the frame borders a lower edge of the chin shell portion;

wherein the frame opening is located at the lower edge of the outer shell; and wherein an entirety of the frame is spaced from the outer shell.

* * * * *